United States Patent [19]

Austin

[11] Patent Number: 4,974,490

[45] Date of Patent: Dec. 4, 1990

[54] MULTI-BAY MAGAZINE FOR BELTED AMMUNITION

[75] Inventor: Paul A. Austin, Shelburne, Vt.

[73] Assignee: General Electric Company, Burlington, Vt.

[21] Appl. No.: 444,348

[22] Filed: Dec. 1, 1989

[51] Int. Cl.[5] ..... F41A 9/79

[52] U.S. Cl. ..... 89/34; 89/33.16

[58] Field of Search ..... 89/34, 33.1, 33.14, 89/33.16; 206/3

[56] References Cited

U.S. PATENT DOCUMENTS

| | | | |
|---|---|---|---|
| 2,382,715 | 8/1945 | Hertel | 89/33.16 |
| 2,398,263 | 4/1946 | Trimbach | 89/34 |
| 2,452,545 | 11/1948 | Broga | 89/34 |
| 2,459,934 | 1/1949 | Haberlin | 89/34 |
| 2,710,561 | 6/1955 | Dowd | 206/3 |
| 2,811,084 | 10/1957 | Cook et al. | 89/34 |
| 2,874,615 | 2/1959 | Kravik | 89/34 |
| 2,889,751 | 6/1959 | Bilek | 89/34 |
| 3,580,131 | 5/1971 | Zimmerman | 89/34 |
| 4,393,746 | 7/1983 | Rocha | 89/34 |

FOREIGN PATENT DOCUMENTS

| | | | |
|---|---|---|---|
| 141109 | 5/1985 | European Pat. Off. | 89/34 |
| 1213410 | 11/1970 | United Kingdom | 89/33.14 |

*Primary Examiner*—Charles T. Jordan
*Assistant Examiner*—Stephen Johnson
*Attorney, Agent, or Firm*—Bailin L. Kuch; Robert A. Cahill

[57] ABSTRACT

A magazine is provided with anti-syphon members, mounted atop the partitions of a multi-bay magazine, which operate in conjunction with drag-reducing rollers to prevent spurious syphoning movements of an ammunition belt from one bay to an adjacent bay as the belt is being withdrawn from the latter to a magazine exit port. To provide for bidirectional ammunition belt withdrawal, the anti-syphon members are pivotally mounted in pairs operating to permit belt withdrawal from the bays over the rollers and directly to an exit port, while inhibiting syphoning belt movements from bay to bay.

17 Claims, 2 Drawing Sheets

FIG. 2
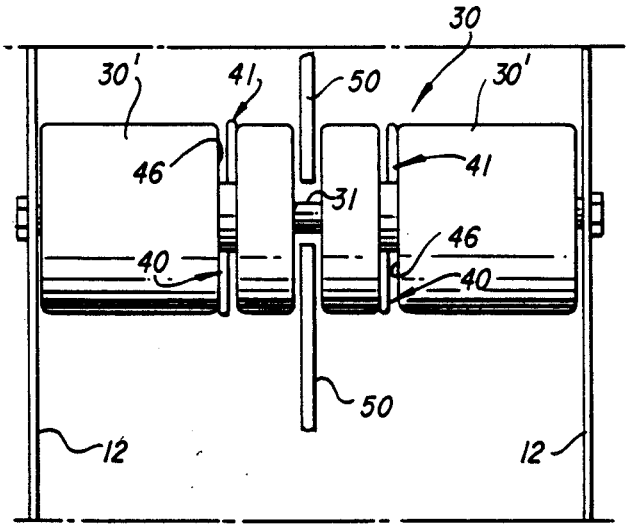
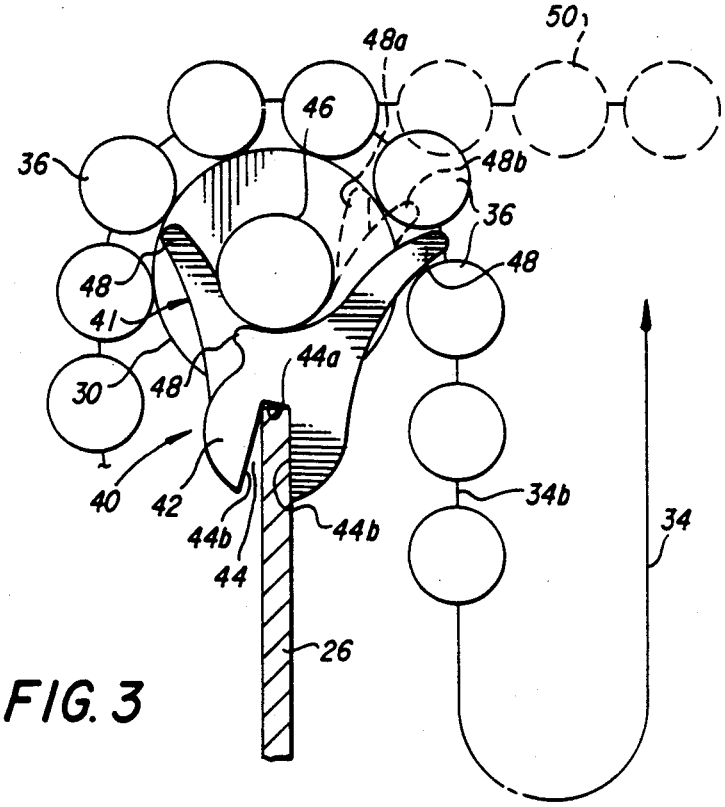
FIG. 3

MULTI-BAY MAGAZINE FOR BELTED AMMUNITION

The present invention relates to ammunition containers for storing linked rounds of ammunition in ready condition for feeding to a rapid-fire gun.

BACKGROUND OF THE INVENTION

A typical magazine or can for linked or belted rounds of ammunition includes a plurality of partitions for subdividing the can interior into multiple compartments or bays. A continuous ammunition belt is loaded in the can with portions thereof in each bay arranged in layers built up from the bottom in serpentine fashion. From the uppermost layer in each bay, the ammunition belt is drawn over the top of the partitions and runs downwardly to the bottom of the adjacent bay. The leading end of the ammunition belt is directed out through an exit port from an adjacent bay and on to the rapid-fire gun. When the ammunition belt is withdrawn to feed successive rounds to the gun, the bays are emptied in succession. To reduce drag, the ammunition belt may be drawn over rollers positioned above the partitions, as disclosed in Trimbach U.S. Pat. No. 2,398,263.

While this loading arrangement provides optimum packaging density, problems are encountered during withdrawal of an ammunition belt, particularly when drag-reducing rollers are utilized between bays. As a bay is being emptied of its serpentine layers from top to bottom, a point is reached when the weight of the freed belt segment suspended from the roller is sufficient to pull belted ammunition rounds out of the adjacent bay, over the roller and down into the bay being emptied. These rounds "syphoned" from the adjacent bay uncontrollably pile up on the upper serpentine layer in the bay being emptied, thereby seriously impeding belt withdrawal to the point that the links between rounds can be damaged or even severed. Damage links typically result in jams, and severed links deny access to that portion of the ammunition belt beyond the break. In either case, the rapid-fire gun is shortly out of action.

SUMMARY OF THE INVENTION

It is accordingly an object of the present invention to provide an improved multi-bay magazine for belted ammunition.

A further object is to provide an ammunition magazine of the above-character, wherein impediments to the smooth withdrawal of an ammunition belt therefrom are avoided.

An additional object is to provide an ammunition magazine of the above-character, wherein an ammunition belt is drawn completely out of each bay in succession.

Yet another object is to provide an ammunition magazine of the above-character, wherein spurious movements of the ammunition belt between bays are inhibited.

A still further object is to provide an ammunition magazine of the above-character, which is economical to manufacture, simple in construction, and reliable in operation over a long service life.

Other objects of the invention will in part be obvious and in part appear hereinafter.

In accordance with the present invention, there is provided an ammunition magazine or container of box-like shape and having a plurality of partitions subdividing the interior thereof into a plurality of bays. A roller is positioned above the upper edge of each partition. An ammunition belt is loaded into the magazine with portions thereof multiply folded in serpentine formation deposited in each bay and interconnecting loop portions thereof drawn over the rollers from bay to bay. An anti-syphon member is supported on the upper edge of each partition to present an integral finger in an extended position relative to the peripheral surface of the adjacent roller. The fingers, in their extended positions, are effective to catch the loop portions of the ammunition belt to inhibit syphoning movements thereof from a succeeding bay into a bay from which the ammunition belt is being withdrawn.

As an important feature of the present invention, a pair of anti-syphon members are supported in juxtaposed relation on the upper edge of each partition for independent, limited pivotal movements to swing their respective fingers between retracted and extended positions relative to the adjacent roller peripheral surface at respective angularly spaced locations. The fingers assume their retracted positions to permit belt movements out of the bays and automatically assume their extended positions to inhibit syphoning belt movements into the bays, thereby adapting the magazine to bidirectional ammunition belt withdrawal.

The invention accordingly comprises the features of construction, combination of elements, and arrangement of parts, all as described hereinbelow, and the scope of the invention will be indicated in the claims.

BRIEF DESCRIPTION OF THE DRAWINGS

For a full understanding of the nature and objects of the present invention, reference may be had to the following Detailed Description taken in conjunction with the accompanying drawings, in which:

FIG. 2 is an enlarged, fragmentary plan view of one of the rollers seen in the embodiment of FIG. 1; and FIG. 3 is an enlarged side view of one of the pairs of anti-syphon members seen in FIG. 1.

Corresponding reference numerals refer to like parts throughout the several views of the drawings.

DETAILED DESCRIPTION

Figure 1:
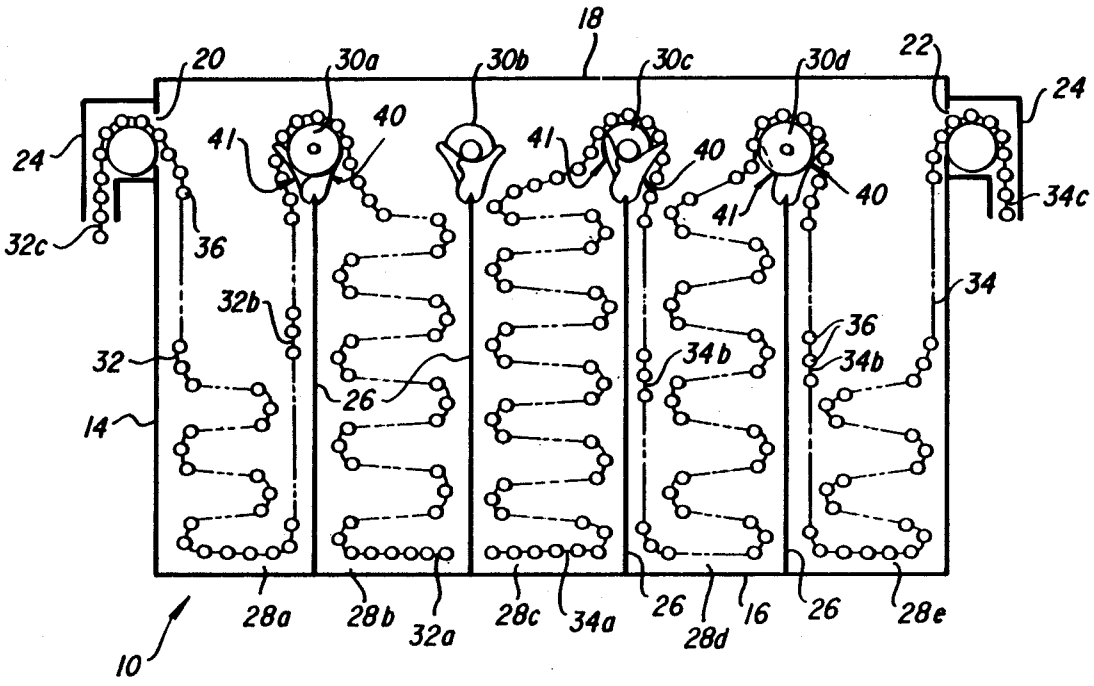
FIG. 1 is a side-elevational view, in diagrammatic form, of an ammunition magazine constructed in accordance with an embodiment of the present invention.

The ammunition magazine of the present invention, generally indicated at 10 in FIG. 1, includes opposed sidewalls 12 (FIG. 2), opposed endwalls 14, and a bottom wall 16 joined together by suitable means such as welding, rivets, etc., to provide a structurally rigid, box-like structure. The top of the magazine is closed off by one or more removable covers 18. In the illustrated embodiment, the magazine is optionally adapted, such as in the manner disclosed in Applicant's copending application entitled "Multiply Adaptable Magazine Assembly" Ser. No. 444,349, filed concurrently herewith, with exit ports 20 and 22, one at each end, and to which modular feed chutes 24 are installed. The disclosure of this copending application is specifically incorporated herein by reference. The magazine is equipped with spaced partitions 26 affixed to and spanning the sidewalls to subdivide the interior into a plurality of bays **28*a*–28*e* arrayed between the endwalls. Rotatably mounted by the sidewalls in position above each partition are separate rollers 30*a*–30*d*. One of these rollers is collectively indicated at 30 in FIGS. 2 and 3**.

The ammunition magazine is illustrated in FIG. 1 in its adaptation to accommodate two ammunition belts 32 and 34, each consisting of linked ammunition rounds 36 Belt 32 is stored with its trailing end 32*a* lying in the bottom of bay 28*b* and folded on itself in layered, serpentine fashion to fill this bay. From the uppermost layer, the belt is drawn over roller 30*a* and down to the bottom of bay 28*a* as an interconnecting loop portion 32*b*. From the bottom of bay 28*a*, the belt is layered upwardly in serpentine fashion, with the leading end 32*c* drawn out from the uppermost layer through exit port 20 and feed chute 24 to a rapid-fire gun (not shown). Belt 34 is accommodated with its trailing end 34*a* lying at the bottom of bay 28*c* and is layered upwardly in this bay. From the uppermost layer, this belt is drawn over roller 30*c* and extends down to the bottom of bay 28*d* as an interconnecting loop portion 34*b*. From the bottom of this bay, the belt is serpentined upwardly, drawn over roller 30*d* and draped downwardly to the bottom of bay 28*e* as a second interconnecting loop portion 34*b*. From the bottom of this bay, belt 34 is layered upwardly, with its leading end 34*c* brought out from the uppermost layer through exit port 22 and feed chute 24 to a second rapid-fire gun, also not shown. It is seen that, upon gun-feeding withdrawal of belt 32, the serpentine layers in bay 28*a* are progressively unfolded to empty this bay first, and then the belt is drawn over roller 30*a* along a direct path to exit port 20 to empty bay 28*b*. In the same fashion, withdrawal of belt 34 through exit port 22 empties bay 28*e* first, followed by bay 28*d* and then bay 28*c*.

It is seen from the description thus far that the inclusion of rollers 30*a* and 30*e* serves to significantly reduce the frictional drag on these belts during withdrawal to feed ammunition rounds 36 to the two guns. Unfortunately, this reduced drag inherently creates a condition which can impose a severe impediment to successful ammunition belt withdrawal. This condition occurs as a bay is being emptied. As can be appreciated from FIG. 1, as the serpentine layers in bay 28*a* are unfolded and drawn out, the weight of the interconnecting loop portion 32*b* of the belt between roller 30*a* and the uppermost layer in bay 28*a* ultimately becomes sufficient to pull the belt over this roller and out of bay 28*b*. The additional ammunition rounds 36 spurious syphoned into bay 28*a* from bay 28*b* pile up on the uppermost layer in bay 28*a*, thus impeding its unfolding and withdrawal. It is seen that the same syphoning condition can occur in bays 28*e* and 28*d* with regard to ammunition belt 34. The additional feeding force to maintain uniform belt withdraw can damage or even sever the links between rounds. Damaged links typically result in jamming of the delinking mechanism, and link severance renders the length of ammunition belt beyond the break unavailable to the gun.

In accordance with the present invention, this spurious syphoning condition is avoided by the utilization of anti-syphon members in conjunction with each of the rollers 30. Each anti-syphon member, generally indicated at 40 and best seen in FIG. 3, is identically formed from a metal blank to provide a body 42 in which is cut a downwardly opening notch 44 having a flat bottom 44*a* and diverging sides 44*b*. The anti-syphon member is supported by a partition 26 with the upper partition edge seated in notch 44. This support position is preserved by providing a circumferential groove 46 in roller 30 in which the anti-syphon member is received. A protuberance 48 on body 42 lies in closely spaced relation below the bottom of roller groove 46 to maintain the anti-syphon member seated on the partition upper edge. The sidewalls of the roller groove maintain the anti-syphon member in an upright orientation.

The divergent straight edges 44*b* of notch 44 permit limited pivotal motion of the anti-syphon member such as to rock a finger 48 projecting from body 42 in and out of roller groove 46 between a retracted position, indicated in phantom at 48*a*, lying below the roller peripheral surface and an extended, solid line position with its tip projecting beyond the roller peripheral surface. In its extended position, finger 48 is effective to catch an ammunition belt, such as belt 34 in FIG. 1, and thereby inhibit belt movement in the clockwise direction about roller 30. Thus, the finger supports the weight of the interconnecting loop portion 34*b* of belt 34 suspended into a bay, e.g. bay 28*e*, as it is being emptied. Thus, syphoning of the ammunition belt from a succeeding bay, e.g. bay 28*d*, is prevented. When a bay is completely emptied, the belt assumes the indicated phantom line path 49 leading directly to a magazine exit port, which is seen to be well removed from finger 48 in its extended position.

It will be appreciated that fingers 48 can be manually set to their extended positions in catching engagements with an ammunition belt to support its interconnecting loop portions during the loading of magazine 10. As a precaution against the omission of manually setting the fingers to their extended positions, the flat bottom 44*a* of notch 44 seated on the squared off upper edge of a partition serves to establish a quiescent finger position, indicated in phantom at 48*b*, intermediate the retracted and extended finger positions. In this position inherently assumed by the anti-syphon members, their finger tips project slightly beyond the roller periphery, sufficient to be driven to their extended positions by initial syphoning motion of the ammunition belt.

To provide belt syphon prevention regardless of the direction of ammunition belt withdrawal, a pair of anti-syphon members 40 and 41 are supported atop each partition 26 in mirror image relation, i.e., turned 180° relative to each other. For convenience, the anti-syphon members of each pair are juxtaposed in side-by-side relation so they can be accommodated in the same roller groove 46, as best seen in FIG. 2. Depending on the direction of ammunition belt feed, one anti-syphon member of each pair assumes its retracted position to permit belt withdrawal from a bay to an exit port, while the other member is in its extended position to prevent syphoning belt movement into a bay from an adjacent bay. Thus, as seen in FIG. 1 wherein the feed directions of ammunition belts 32 and 34 are in relatively opposite directions, anti-syphon members 40 and 41 of the pair associated with roller 30*a* are respectively in their retracted and extended finger positions. The anti-syphon member pair associated with roller 30*b* are both in the quiescent finger positions since there is no interconnecting loop portion of an ammunition belt trained over this roller. Of the pairs associated with rollers 30*c* and 30*d*, anti-syphon members 40 are in their extended finger positions, while members 41 are in their retracted finger positions.

If magazine 10 is of the construction disclosed and claimed in the above-cited copending application such as to be multiply adaptable to dual caliber as well as bidirectional ammunition belt feed, two pairs of anti-syphon members 40, 41 are supported atop each partition in association with each roller 30, as seen in FIG. 2.

Each magazine bay is optionally subdivided into bay sections by the installation of separators 50, into which a belt or belts of smaller caliber ammunition are loaded. Roller 30 is provided with a circumferential groove at its mid-length point or as roller sections 30' carried on a common shaft 31 to accommodate separator installation. Each roller section is circumferentially grooved, as indicated at 46, to accommodate separate pairs of anti-syphon members 40, 41 in operative positions with respect to the bay sections to prevent syphoning movements of a small caliber ammunition belt(s) being withdrawn therefrom. It will be appreciated that one or the other of the anti-syphon member pairs associated with each roller, depending on ammunition round orientation, is effective to prevent siphoning movements of a belt or belts of larger caliber ammunition being withdrawn from the bays.

It is seen that the objects of the invention set forth above, including those made apparent in the Detailed Description, are efficiently attained, and, since certain changes may be made in the construction set forth without departing from the invention, it is intended that all matters of detail be taken as illustrative and not in a limiting sense.

Having described the invention, what is claimed as new and desired to secure by Letters Patent is:

1. A magazine for storing a belt of ammunition, said magazine comprising, in combination:

A. a container having opposed sidewalls, opposed endwalls, and a bottom wall conjoined to provide a box-like structure, said container including at least one exit port;

B. a plurality of spaced partitions affixed in spanning relation with said sidewalls to subdivide said container into a plurality of bays, each of said partitions having an upper edge;

C. a separate roller rotatably mounted by said container in positions spaced above said upper edge of each of said partitions, each said roller having a peripheral surface; and D. an anti-syphon member supported on said upper edge of each of said partitions for limited pivotal movement, each said member having an integral projecting finger movable between retracted and extended positions relative to said peripheral surface of an adjacent said roller;

E. whereby, upon withdrawal of an ammunition belt loaded in said container with multiply folded serpentine portions thereof deposited in each of said bays and with an interconnecting loop portion thereof draped over each said roller from one of said bays to an adjacent one of said bays, each said finger assumes said retracted position to permit movement of the belt out of said bays directly to said exit port and assumes said extended position engaging an interconnecting loop portion of the ammunition belt to prevent syphoning movements thereof into said bays as the serpentine belt portions are being withdrawn therefrom to said exit port.

2. The magazine defined in claim 1, wherein each said anti-syphon member is provided with a downwardly opening notch for receiving said upper edge of said partition.

3. The magazine defined in claim 2, wherein each said roller is provided with a circumferential groove for receiving said anti-syphon member.

4. The magazine defined in claim 3, wherein each said notch is provided with divergent sides to define the limited pivotal movements of said anti-syphon member.

5. The magazine defined in claim 4, wherein said upper edge of each of said partitions is squared off, and each said notch is provided with a flat bottom, whereby, with said notch bottom bearing fully on said upper edge of one of said partitions, each said finger assumes a quiescent position intermediate said retracted and extended positions, each said finger in said quiescent position protruding beyond said peripheral surface of said adjacent said roller such as to be propelled to said extended position in response to initial siphoning movements of the belt interconnecting loop portion.

6. The magazine defined in claim 5, wherein each said anti-syphon member is identically formed from a metal blank.

7. The magazine defined in claim 1, wherein each said anti-syphon member is provided as a pair of said anti-syphon member pivotally mounted on said upper edge of each of said partitions.

8. The magazine defined in claim 7, wherein said anti-syphon members of each said pair are arranged in mirror image relation.

9. The magazine defined in claim 8, wherein each said anti-syphon member is provided with a downwardly opening notch for receiving said upper edge of each of said partitions.

10. The magazine defined in claim 9, wherein each said roller is provided with a circumferential groove for receiving one said pair of said anti-syphon members in juxtaposed relation.

11. The magazine defined in claim 10, wherein each said notch is provided with divergent sides to define the limited pivotal movements of said anti-syphon member of each said pair.

12. The magazine defined in claim 11, wherein said upper edge of each of said partitions is squared off, and each said notch is provided with a flat bottom, whereby, with said notch bottom bearing fully on said upper edge of each of said partitions, each said finger assumes a quiescent position intermediate said retracted and extended positions, each said finger in said quiescent position protruding beyond said peripheral surface of said adjacent said roller such as to be propelled to said extended position in response to initial siphoning movements of the belt interconnecting loop portion.

13. The magazine defined in claim 12, wherein each said anti-syphon member is identically formed from a metal blank.

14. The magazine defined in claim 7, wherein two pairs of said anti-syphon members are pivotally mounted on said upper edge of each said partition.

15. The magazine defined in claim 14, wherein said anti-syphon members of each said pair are arranged in mirror image relation.

16. The magazine defined in claim 15, wherein each said roller is provided with a pair of axially spaced, circumferential grooves, each of said grooves receiving one of said anti-syphon member pairs.

17. The magazine defined in claim 16, which further includes at least one separator for subdividing one of said bays into a pair of bay sections, said separator being located between said roller grooves of said axially spaced pair.

* * * * *